US005380612A

United States Patent [19]

Kojima et al.

[11] Patent Number: 5,380,612

[45] Date of Patent: Jan. 10, 1995

[54] PROCESS FOR MANUFACTURING PLANOGRAPHIC PRINTING PLATE

[75] Inventors: Yasuo Kojima, Tama; Katsura Hirai; Kiyoshi Goto, both of Hachioji, all of Japan

[73] Assignee: Konica Corporation, Tokyo, Japan

[21] Appl. No.: 59,750

[22] Filed: May 12, 1993

[30] Foreign Application Priority Data

May 18, 1992 [JP] Japan ..... 4-124938

[51] Int. Cl.[6] ..... G03G 13/10; G03G 13/12; G03G 13/22

[52] U.S. Cl. ..... 430/49; 430/117; 430/119; 430/302; 430/306

[58] Field of Search ..... 430/49, 117, 302, 306, 430/119

[56] References Cited

U.S. PATENT DOCUMENTS

| | | | |
|---|---|---|---|
| 2,714,066 | 7/1955 | Jewett et al. . | |
| 3,515,552 | 6/1970 | Smith et al. . | |
| 3,536,489 | 10/1970 | Smith et al. . | |
| 3,658,662 | 4/1972 | Casson, Jr. et al. . | |
| 3,779,778 | 12/1973 | Smith et al. . | |
| 4,500,617 | 2/1985 | Nakayama | 430/49 |
| 4,680,244 | 7/1987 | Lehmann et al. | 430/49 |
| 4,933,248 | 6/1990 | Lind et al. | 430/49 |
| 5,298,357 | 3/1994 | Hattori et al. | 430/119 |

FOREIGN PATENT DOCUMENTS

| | | |
|---|---|---|
| 57-90648 | 6/1982 | Japan . |
| 58-150953 | 9/1983 | Japan . |
| 60-194467 | 10/1985 | Japan . |

*Primary Examiner*—Charles L. Bowers, Jr.
*Assistant Examiner*—Christopher G. Young
*Attorney, Agent, or Firm*—Finnegan, Henderson, Farabow, Garrett & Dunner

[57] ABSTRACT

A process for manufacturing a planographic printing plate using a photosensitive planographic printing plate comprising a conductive support and provided thereon, a photoconductive layer containing an alkali soluble resin, a photoconductor and a photosolubilizable photosensitive compound comprises the steps of forming an electrophotographic latent image on the photoconductive layer, developing the latent image with liquid developer to form a toner image layer, uniformly exposing overall to actinic light the entire photoconductive layer, and removing the photoconductive layer where no toner image layer has been formed, the transmission density of the toner image layer to the actinic light being not less than 0.6, and the transmission density per unit thickness of the toner image layer to the actinic light being not less than 0.03 $dm^2/g$.

12 Claims, No Drawings

PROCESS FOR MANUFACTURING PLANOGRAPHIC PRINTING PLATE

FIELD OF THE INVENTION

The present invention relates to a process for the preparation of a planographic printing plate by use of a photosensitive printing plate having, on a conductive support, a layer containing a photoconductor and a photo-solubilizable photosensitive compound in admixture or separately. More specifically, the present invention relates to a process for the preparation of a planographic printing plate which comprises the steps of forming a toner image on the layer by electrophotography, followed by overall exposing, and removing a non-image layer by dissolving.

BACKGROUND OF THE INVENTION

As a process for the preparation of a printing plate by use of electrophotography, there has so far been used a technique which comprises the steps of forming a toner image on a photoconductive layer of a photosensitive printing plate having a photoconductive layer on a support and, then, removing a non-toner portion of the photoconductive layer by dissolution development.

The foregoing technique, however, has a disadvantage that a dissolution solution permeates a photoconductive layer beneath an image portion where a toner image is formed during the dissolution development and, thereby, causes so-called side etching to remove this image portion; as a result, image reproducibility is impaired, or small dots and fine lines to be maintained are dissolved or removed.

In order to eliminate such a disadvantage, there is proposed a technique to give an electrophotographic photosensitive layer an exposure solubility difference by introducing a photo-solubilizable photosensitive compound into the electrophotographic photosensitive layer, and carrying out overall exposure after formation of a toner image (British Patent No. 996,315, Japanese Pat. O.P.I. Pub. Nos. 90648/1982, 150953/1983, 194467/1985, etc.). Further, formation of a toner image by use of a liquid developer is also known as a means to improve resolution (Japanese Pat. O.P.I. Pub. Nos. 90648/1982, 170862/1984, etc.).

It is known that electric charge per unit weight of toner in a liquid developer is about ten times that of a dry toner and thus it is difficult to give a high density in developing. When such a liquid developer is used in wet copying whose primary object is to obtain a hard copy on copying paper, a reflection density of about 1.2, and a transmission density of 0.5 or less are sufficient. When ordinarily used in printing plates, the toner of the liquid developer is not required to have a high transmission density, either, because visibility is not necessarily required as long as the toner functions as a resist in hydrophilicity providing treatment or dissolution removal of a non-image portion.

However, in the photomechanical process that uses a photo-solubilizable photosensitive compound and a photoconductor in combination to give an exposure solubility difference between image portions and non-image portions of a photoconductive layer by carrying out post exposure using a toner image as a mask, there is a problem that the transmission density of a toner layer formed by liquid development is not necessarily satisfactory as compared with that obtained by use of a dry toner.

When a photo-solubilizable photosensitive compound and a photoconductor are present in the same layer, a high toner density is especially required because a long post exposure time is necessary.

A low transmission density of a toner layer cannot give an adequate exposure solubility difference between image portions and non image portions and, thereby, lowers the dissolution latitude and reproducibility of small dots and fine lines.

Further, addition of a photo-solubilizable photosensitive compound in a large amount is necessary to impart a clear exposure solubility difference between image portions and non-image portions; therefore, a toner layer is required to have a transmission density high enough to allow an adequate post exposure in order to decompose thoroughly the photo-solubilizable photosensitive compound added in a large amount.

However, when the toner layer is made thicker to raise the transmission density, there arises another problem that the image reproducibility is lowered.

SUMMARY OF THE INVENTION

Accordingly, in the photomechanical process to make a printing plate using a photosensitive printing plate having a conductive support carrying thereon a photoconductor and a photo,solubilizable photosensitive compound, an object of the present invention is to provide a photomechanical process for the preparation of printing plates having an improved dissolution latitude, and another object of the present invention is to provide a photomechanical process for the preparation of a printing plate having an improved reproducibility of small dots and fine lines.

DETAILED DESCRIPTION OF THE INVENTION

The present inventors have continued a close study and accomplished this invention by a process for the preparation of planographic printing plates which comprises charging, imagewise exposure, liquid developer development, overall exposure and removal of non-image portions of a photosensitive planographic printing plate comprising a conductive support carrying thereon a photoconductor and a photo-solubilizable photosensitive compound, wherein light used in the overall exposure is light sensitive to the photo-solubilizable photosensitive compound, transmission density of a toner layer formed by development is not less than 0.6 in relation to the light used in the overall exposure, and the transmission density per unit thickness (weight/unit area) of the toner layer is not less than 0.03 $dm^2/mg$ in relation to said light.

The invention is hereunder described in detail.

The photosensitive planographic printing plate used in the photomechanical process of the invention is a material for making a planographic printing plate, which comprises a hydrophilic conductive support carrying thereon at least a photoconductor and a photo-solubilizable photosensitive compound. These photoconductor and photo-solubilizable photosensitive compound may be present in the same layer as described in Japanese Pat. O.P.I. Pub. No. 170862/1984, or may not be present in the same layer. When these are not present in the same layer, the photoconductor may be present in a layer farther from the support than the layer containing the photo-solubilizable photosensitive compound as described in Japanese Pat. O.P.I. Pub. No. 90648/1982, or it may be present in a layer nearer the support than the layer containing the photo-solubilizable photosensitive compound as described in Japanese Pat. O.P.I. Pub. No. 243966/1991.

Photoconductors usable in the invention include organic or inorganic photoconductive pigments and non-pigment organic photoconductors. Preferred among them are organic photoconductive pigments. Typical examples of such organic photoconductive pigments include the perylene pigments disclosed in Japanese Pat. O.P.I. Pub. Nos. 30330/1972 and 5552/1981; the Quinacridone pigments disclosed in, for example, Japanese Pat. O.P.I. Pub. No. 30331/1972; the bisbenzimidazole pigments disclosed in Japanese Pat. O.P.I. Pub. No. 18543/1972; the aromatic polycondensed ring compounds disclosed in Japanese Pat. O.P.I. Pub. Nos. 18544/1972, 98754/1980, 126254/1980, and 163543/1980; the azo pigments disclosed, for example, in Japanese Pat. Exam. Pub. Nos. 16373/1969 and 30513/1973, and Japanese Pat. O.P.I. Pub. No. 321465/1981; the disazo pigments disclosed, for example, in Japanese Pat. Exam. Pub. No. 7434/1975, Japanese Pat. O.P.I. Pub. Nos. 37548/1972, 11715/1980, 1944/1981, 9752/1981, 2352/1981, and 80050/1981; and the phthalocyanine pigments disclosed, for example, in Japanese Pat. Exam. Pub. Nos. 12671/1969, 2780/1965, 1667/1977, 30035/1971, and 17535/1974, Japanese Pat. O.P.I. Pub. Nos. 11136/1974, 99142/1974, 109841/1976, and 148745/1982. These can be used singly or in combination of two or more kinds.

Among these compounds, the phthalocyanine pigments are preferred in respect of sensitivity and light-sensitive wavelength region.

Usable inorganic photoconductive pigments include zinc oxide and titanium oxide.

Usable organic photoconductors other than pigments are, for example, organic photoconductors disclosed in Japanese Pat. O.P.I. Pub. Nos. 161863/1982, 76843/1983, 100862/1983, 172649/1983, 207049/1983, 44060/1984, 121058/1984, 128559/1984, 178886/1985, 222263/1989, 161354/1989, 163752/1989, 163753/1989, 186967/1989, 186968/1989, 188865/1989 and 216362/1989.

The content of the photoconductors in the photoconductive layer is 3 to 50% by weight, and preferably 5 to 25% by weight.

Typical examples of the photo-solubilizable photosensitive compound used in the invention include quinonediazide compounds and the combination of a photo-induced acid generator and an acid-decomposed compound disclosed in Japanese Pat. O.P.I. Pub. No. 43367/1992.

The quinonediazide compound suitable for the photosensitive printing plate used in the photomechanical process of the invention is not particularly limited in type as long as it has the quinonediazide structure. Preferred are esterified compounds of o-naphthoquinonediazide-sulfonic acid with a polycondensation phenol resin obtained from a phenol and an aldehyde or ketone. Among such esterified compounds, esters of o-naphthoquinonediazide-4 (or 5)-sulfonic acid are preferred, and esters of o-naphthoquinonediazide-4-sulfonic acid are especially preferred for their high electrophotographic properties.

The above phenol includes a monovalent phenol such as phenol, o-cresol, m-cresol, p-cresol, 3,5-xylenol, carvacrol or thymol; a divalent phenol such as catechol, resorcinol or hydroquinone; and a trivalent phenol such as pyrogallol or phloroglucinol. The above aldehyde includes formaldehyde, benzaldehyde, acetaldehyde, crotonaldehyde or furfural; among them, formaldehyde and benzaldehyde are preferred. Suitable ketones are, for example, acetone and methyl ethyl ketone.

Examples of the foregoing polycondensation resin include phenol-formaldehyde resins, p-cresol-formaldehyde resin, m-cresol-formaldehyde resin, m-, p-mixed cresol-formaldehyde resin and pyrogallol-acetone resin. From the viewpoint of electrophotographic properties, polycondensation resins of phenol or o-, m- or p-cresol with formaldehyde are preferred, p-cresol-formaldehyde resin is particularly preferred.

In the above o-naphthoquinonediazide compounds, the condensation ratio of the o-naphthoquinonediazide-sulfonic acid to a OH group of the phenol resin (reaction ratio per OH group) is preferably 15 to 80%, especially 20 to 60%.

In addition to the resins described above, quinonediazide compounds usable in the invention include the compounds described in Japanese Pat. O.P.I. Pub. No. 4345/1983. Examples thereof include conventional 1,2-naphthoquinonediazide compounds such as 1,2-naphthoquinonediazide-sulfonate and 1,2-naphthoquinonediazide-sulfonamide and, further, include 1,2-quinonediazide compounds such as 1,2-naphthoquinonediazide-5-sulfonic acid cyclohexyl ester, 1-(1,2-naphthoquinonediazide-5-sulfonyl)-3,5-dimethylpyrazole, 1,2-naphthoquinonediazide-5-sulfonic acid-4''-hydroxydiphenyl-4''-azo-$\beta$-naphthol ester, N,N-di-(1,2-naphthoquinonediazide-5-sulfonyl)-aniline, 2'-(1,2-naphthoquinonediazide-5-sulfonyloxy)-1-hydroxyanthraquinone, 1,2-naphthoquinonediazide-5-sulfonic acid-2,4-dihydroxybenzophenone ester, 1,2-naphthoquinonediazide-5-sulfonic acid-2,3,4-trihydroxybenzophenone ester, condensate of 2 moles of 1,2-naphthoquinonediazide-5-sulfonic acid chloride with 1 mole of 4,4'-diaminobenzophenone, condensate of 2 moles of 1,2-naphthquinonediazide-5-sulfonic acid chloride with 1 mole of 4,4'-dihydroxy-1,1'-diphenylsulfone, condensate between 1 mole of 1,2-naphthoquinonediazide-5-sulfonic acid chloride and 1 mole of purpurogallin, and 1,2-naphthoquinonediazide-5-(N-dihydroxyabiethyl)-sulfonamide described in J. Kosar, Light-Sensitive Systems, John Wily & Sons, New York, pp. 339–352 (1965) and W. S. De Forest, Photoresist, Vol. 50, McGraw-Hill, New York (1975). Other examples are the 1,2-naphthoquinonediazide compounds described in Japanese Pat. Exam. Pub. Nos. 1953/1962, 3627/1962, 13109/1962, 26126/1965, 3801/1965, 5604/1970, 27345/1970 and 13013/1976, and Japanese Pat. O.P.I. Pub. Nos. 96575/1973, 63802/1973 and 63803/1973.

These quinonediazide compounds may be used singly or in combination of two or more kinds.

Next, a combination of a photo-induced acid generator and an acid decomposition compound suitable for the photosensitive printing plate used in the photomechanical process of the invention will be described below.

The photo-induced acid generator includes compounds capable of generating an acid upon irradiation of active rays. Examples thereof include a variety of familiar compounds and mixtures, such as salts including diazonium salts, phosphonium salts, sulfonium salts, and iodonium salts comprising $BF_4^-$, $PF_8^-$, $SbF_8^-$, $SiF_8^{2-}$ or $ClO_4^-$; organic halogen containing compounds; and ortho-quinonediazidesulfonyl chlorides.

Further, mixtures of an organic metal and an organic halogen containing compound can also be used as an active ray sensitive component capable of forming or releasing an acid upon irradiation of active rays.

In principle, there can be used all the organic halogen containing compounds known as free radical forming photosensitive initiators as photo-induced acid generators to form hydrohalic acids. Examples of such compounds can be seen in U.S. Pat. Nos. 3,515,552, 3,536,489, and 3,779,778 and German Offenlegungsschrift No. 3,243,621.

The acid decomposition compound is a compound which has a bond capable of being decomposed by an acid generated from a photo-induced acid generator.

Such acid decomposition compounds include those having the bond of ≡C—O—C≡ or ≡Si—O—C≡ and those having the bond of ≡C—O—C— or ≡Si—O—C—. Typical examples of the compound having ≡C—O—C≡ bond include compounds having an acetal or ketal group, the compounds having an ortho-carboxylic acid ester group and/or a carboxylic acid amidoacetal group which are disclosed in Japanese Pat. O.P.I. Pub. No. 120714/1976, the polymers having an acetal or ketal group in the principal chain which are disclosed in Japanese Pat. O.P.I. Pub. No. 133429/1978, the compounds having an enol ether group which are disclosed in Japanese Pat. O.P.I. Pub. No. 12995/1980, the compounds having an N-acyliminocarbonic base which are disclosed in Japanese Pat. O.P.I. Pub. No. 126236/1980, and the polymers having an ortho-carboxylic acid ester group in the principal chain which are disclosed in Japanese Pat. O.P.I. Pub. No. 17345/1981.

The photo-induced acid generator and the acid decomposition compound are contained in the same layer to form a photosensitive layer.

The content of the photo-solubilizable photosensitive compound or composition in the photoconductive layer is 10 to 90% by weight, and preferably 20 to 50% by weight. The content of quinonediazide compounds is preferably $0.4\times10^{-3}$ to $3\times10^{-3}$ mol/g.

o-quinonediazide compounds are preferably used as a photo-solubilizable photosensitive compound in the photosensitive printing plate to which the photomechanical process of the invention is applied.

In the photosensitive planographic printing plate according to the invention, the photoconductor and the photo-solubilizable photosensitive compound can be applied to a conductive support in a manner and in an amount as usually employed.

In the photosensitive printing plate according to the invention, the photoconductor and/or the photo-solubilizable photosensitive compound is applied to a conductive support together with a binder resin. A usable binder resin is an alkali soluble resin including a novolak resin and an acrylic resin.

The novolak resin includes copolycondensation products of phenols with active carbonyl compounds. Such phenols include all of the compounds in which at least one hydrogen atom bonded to the aromatic ring is substituted by a hydroxyl group; examples thereof are phenol, o-cresol, m-cresol, p-cresol, 3,5-xylenol, 2, 4-xylenol, 2,5-xylenol, carvacrol, thymol, catechol, resorcinol, hydroquinone, pyrogallol, phloroglucinol and phenols substituted with an alkyl group of 1 to 8 carbon atoms. Preferred are phenol, o-cresol, m-cresol and p-cresol.

The above active carbonyl compounds include aldehydes and ketones such as formaldehyde, acetaldehyde, benzaldehyde, acrolein, furfural and acetone.

Preferred examples of the novolak resin include phenol/m-cresol/formaldehyde copolycondensation resin, o-cresol/m-cresol/formaldehyde copolycondensation resin, m-cresol/p-cresol/formaldehyde copolycondensation resin, o-cresol/m-cresol/p-cresol/formaldehyde copolycondensation resin and phenol/m-cresol/p-cresol/formaldehyde copolycondensation resin.

Among the above polycondensation resins, phenol/m-cresol/p-cresol/formaldehyde resin is particularly preferred. In the resin synthesis, the weight content of phenol (mixing amount in charge stocks) is 0 to 50 wt %, preferably 5 to 30 wt %; the m-cresol to p-cresol ratio is preferably in the range of 3:7 to 7:3 (weight ratio in charge stocks).

These novolak resins may be used singly or in combination of two or more types.

The molecular weight of the novolak resins (using polystyrene as standard) is preferably $3.00\times10^2$ to $7.50\times10^3$ in number average molecular weight (Mn) and $1.00\times10^3$ to $3.00\times10^4$ in weight average molecular weight (Mw), more preferably $5.00\times10^2$ to $4.00\times10^3$ in Mn and $3.00\times10^3$ to $2.00\times10^4$ in Mw.

Measurement of the molecular weight of the novolak resins is carried out by gel permeation chromatography. The number average molecular weight Mn and weight average molecular weight Mw are calculated by leveling a peak in the oligomer region (taking a mean value on the line connecting the peak and the lowermost point) according to the method described in Morio Tsuge et al., Journal of Japanese Chemical Society, pp. 800–805 (1972).

The weight ratio of phenols used in the novolak resin synthesis can be determined by pyrolysis gas chromatography. The principle, apparatus and experiment conditions of the pyrolysis gas chromatography are described, for example, in Arata Tsuge, SHIN JIKKEN KAGAKU KOZA 19, KOBUNSHI KAGAKU [I] (New Experimental Chemistry Vol. 19, Polymer Chemistry [I]), edited by Japanese Chem. Soc., published by Maruzen Co., pp. 474–485 (1978), and the qualitative analysis of the novolak resins is to be carried out according to the method described in Morio Tsuge et al., BUNSEKI KAGAKU (Analytical Chemistry), Vol. 18, pp. 47–52 (1969).

The acrylic resins according to the invention include copolymers of acrylates or methacrylates with vinyl acetate, methacrylamide, vinylpyrrolidone, a carboxylic acid-containing monomer such as acrylic acid, methacrylic acid, itaconic acid, crotonic acid, maleic acid or fumalic acid, an acid anhydride containing monomer such as maleic anhydride or a monomer having a phenolic hydroxyl group, a sulfonic acid group, a sulfonamide group or a sulfonimide group, for example, methacrylic acid/methacrylate copolymers, styrene/methacrylic acid/methacrylate copolymers, acrylic acid/methacrylate copolymers, styrene/acrylic acid/methacrylate copolymers or vinyl acetate/crotonic acid/methacrylate copolymers.

In addition to the above, there may be used as binder resins styrene/maleic anhydride copolymers, styrene/maleic acid monoalkylate copolymers, partially saponified vinyl acetate resins, or vinyl acetal resins such as polyvinylbutyrals.

The alkali soluble resin of the invention is preferably a novolak resin or an acrylic resin.

The copolymers containing a monomer having an acid anhydride group or carboxyl group as a copolymerization component, and the phenol resins, are preferred because of their capabilities of providing a photoconductive layer with a high charge holding capacity and other favorable electrophotographic properties.

Among the copolymers comprising a monomer having an acid anhydride group, styrene/maleic anhydride copolymers are preferred. Half esters of these copolymers can also be favorably used. Among the copolymers comprising a monomer having a carboxyl group, preferred ones are binary or more multicomponent copolymers of acrylic acid or methacrylic acid with an alkyl ester, aryl ester or aralkyl ester of acrylic acid or methacrylic acid. Copolymers of vinyl acetate and crotonic acid, and terpolymers of vinyl acetate, vinyl ester of a carboxylic acid having 2 to 18 carbon atoms and crotonic acid are also preferred.

Hydrophilic conductive supports are used as supports of photosensitive printing plates of the invention. Usable hydrophilic conductive supports are those which are subjected to surface treatment to impart hydrophilicity and conductivity and have a high dimensional stability.

The supports include paper; paper laminated with a plastic such as polyethylene, polypropylene or polystyrene; films of plastics such as cellulose diacetate, cellulose triacetate, cellulose propionate, cellulose acetate, cellulose acetate butylate, cellulose nitrate, polyethylene terephthalate, polyethylene, polypropylene, polystyrene, polycarbonate and polyvinyl acetal; hydrophilic metal plates such as aluminium plates, zinc plates, iron plates subjected to surface treatment such as chrome plating, bimetal plates including copper-aluminium plates, copper-stainless steel plates and chromium-copper plates, trimetal plates including chromium-copper-aluminium plates, chromium-copper-iron plates and chromium-copper-stainless steel plates; and supports having a hydrophic surface such as paper or film supports subjected to surface treatment with the above metals and three-layered supports obtained by sandwiching a resin layer between metal plates such as aluminium plates.

In the case of supports having plastic surfaces, it is preferable that these supports be Subjected to surface treatment such as chemical treatment, discharge treatment, flame treatment, ultraviolet treatment, high-frequency glow discharge treatment or active plasma treatment. It is also preferable that paper or plastic supports be subjected to hydrophilicity-providing surface coating. A preferred example of such coating comprises surface coating for graining with a coating solution prepared by dispersing hydrophilic particles, such as colloidal silica, in a hydrophilic resin.

For supports having an aluminium surface, it is preferable that these be subjected to surface treatment such as graining; immersing in an aqueous solution of sodium silicate, potassium fluorozirconate or a phosphate; or anodizing. It is also preferable to use an aluminium plate subjected to graining and then immersed in an aqueous sodium silicate solution as described in U.S. Pat. No. 2,714,066, or an aluminium plate which is anodized and then immersed in an aqueous solution of alkali metal silicate as described in Japanese Pat. Exam. Pub. No. 5125/1972.

The above graining of the aluminum surface can be carried out by etching selectrolytically using a solution containing hydrochloric acid, nitric acid, sulfuric acid or phosphoric acid, or by mechanical graining such as ball graining, brush graining, press graining or horning.

The anodizing can be performed by applying an electric current, using an aluminium plate as anode, to an electrolyte containing an inorganic acid such as phosphoric acid, chromic acid, sulfuric acid or nitric acid; an organic acid such as oxalic acid or sulfamic acid; an aqueous or nonaqueous solution thereof; or a combination thereof. The amount of a surface oxide formed by the anodizing is preferably 10 to 50 mg/dm$^2$. Preferably, the anodizing is followed by sealing treatment using hot water, silicates, phosphates or fluorozirconates.

The silicate electrodeposition disclosed in U.S. Pat. No. 3,658,662 is another useful method. The treatment by use of polyvinylphosphonic acid disclosed in German Offenlegungsschrift No. 1,621,478 is useful, too.

These hydrophilicity providing treatments are carried out not only for making the support surface hydrophilic, but also for preventing a support from undergoing an undesired reaction with an electrophotographic photosensitive layer to be formed thereon and enhancing the adhesion to the layer.

The support of the invention is preferably an aluminium plate, and more preferably an anodized aluminium plate.

If necessary, there may be provided, between the hydrophilic support and the electrophotographic photosensitive layer, a water-soluble or alkali-soluble intermediate layer comprising casein, polyvinyl alcohol, carboxymethyl cellulose, ethyl cellulose, phenolic resin, styrene/maleic anhydride copolymer or polyacrylic acid, for the purposes of improving the adhesion to the aforementioned support, facilitating the dissolution of the electrophotographic photosensitive layer and enhancing electrophotographic properties.

In manufacturing the photosensitive planographic printing plate of the invention, photoconductive layer components primarily comprising a photoconductor, a photo-solubilizable photosensitive compound and a binder resin are mixed in an organic solvent and then dispersed uniformly with a ball mill, a supersonic disperser or other dispersing means.

As solvents or dispersing media used in the preparation of a coating solution for the photoconductive layer of the invention, there can be used organic solvents such as alcohols including propanol, butanol, amyl alcohol, hexanol, cyclohexanol; ketones including methyl ethyl ketone, acetone, cyclohexanone, methyl propyl ketone, and methyl isobutyl ketone, esters including methyl lactate, ethyl lactate, and butyl acetate, polyhydric alcohols and ethers or acetates thereof including ethylene glycol, propylene glycol, diethylene glycol, ethylene glycol monomethyl ether, ethylene glycol monomethyl ether acetate, ethylene glycol monoethyl ether, ethylene glycol monoethyl acetate, ethylene glycol monopropyl ether, propylene glycol monomethyl ether, propylene glycol monoethyl ether, propylene glycol monopropyl ether, propylene glycol monoisopropyl ether, propylene glycol monomethyl ether acetate, propylene glycol monoethyl ether acetate, propylene glycol monopropyl ether acetate, propylene glycol monoisopropyl ether acetate, diethylene glycol dimethyl ether, diethylene glycol diethyl ether, diethylene glycol methyl ethyl ethanol, diethylene glycol methyl ethyl ether, and diethylene glycol diethyl ether, tetrahydrofuran and dioxane.

In the invention, the solvent may be used singly or in combination.

The photoconductive composition so prepared is coated and dried on a conductive support to a dry coating thickness of 1 to 10 μm, preferably 1 to 5 μm to obtain a photosensitive planographic printing plate. The resulting plate may be further subjected to heat treatment if necessary. The coating can be performed by conventional methods such as wire-bar coating, dip coating, blade coating, reverse-roll coating, air-knife coating and extrusion coating.

Since the toner employed in the invention is required to have a desired density to the actinic light used in post exposure, addition of a colorant or a light absorbent (hereinafter referred to as a colorant and the like) cannot be dispensed with. Such a colorant and the like can be arbitrarily selected as long as these are adequately absorptive to the actinic light used. Suitable colorants and the like are, for example, carbon black, Nigrosine, Phthalocyanine Blue, Phthalocyanine Green, Benzidine Yellow as well as UV absorbents including benzotriazole compounds, cinnamate compounds, aminoallylidene malononitrile compounds and benzophenone compounds. Since ultraviolet rays are preferably used in the post exposure, it is desirous that the colorant or the light absorbent have an absorption in the ultraviolet wavelength region.

Preferred of them are UV absorbents having an absorption in the ultraviolet wavelength region but not in the visible wavelength region, because these do not cause stains even when the toner layer is released in the color printing process.

The toner used in the invention is preferably hydrophobic and ink-receptive and contains a high-molecular compound such as a polystyrene resin, polyolefin resin, polyester resin (comprising an amino-group-containing acrylate or a long-chain acrylate), acrylic resin (containing a phenolic hydroxyl group or a sulfone group), epoxy resin, vegetable-oil-modified alkyd resin, cyclized rubber, asphalt or polyvinyl chloride. Further, there may also be contained, within the limits not harmful to toner's granulation property and fixing property, a charge controlling agent such as a metal salt of a fatty acid or naphthenic acid, metal-containing dye or sulfonate.

A carrier liquid used in the liquid developer of the invention is a dispersion solvent having a high insulating property and a low dielectric constant and dispersing charged toner particles. The carrier includes an aliphatic carbohydrate or a halogenated derivative thereof. The aliphatic carbohydrate includes n-hexane, n-pentane, isooctane, isododecane, isoparaffines produced by Exxon Co., for example, Isopar H, Isopar G, Isopar L and Isopar E, and Shellsol produced by Shell Petroleum Co. The halogenated derivative includes tetrachloroethane or perfluoroethylene. The toner particles content of liquid developer of the invention is 0.05 to 10% by weight. The carrier has a dielectric constant of 3 or less and a solubility parameter of 8.5 or less.

The liquid developer of the invention is prepared by dispersing a polymer, a polyolefin, pigments or dyes and optionally charge controlling agents in the above liquid carrier by means of a ball mill, sand mill, colloid mill or ultrasonic dispersion method.

In order to achieve a transmission density of 0.03 $dm^2/mg$ per unit thickness of toner layer (represented in terms of $mg/dm^2$), it is preferred that the content of the colorant or light absorbent be not less than 25% by weight of the carrier-insoluble component contained in the toner. The content of the colorant is more preferably 25 to 50% by weight in dispersion stability of liquid developer.

In the photomechanical process of the invention, toner images are formed by a method comprising the steps of charging the photoconductive layer by the usual corona discharge method, exposing imagewise the layer by means of reflection exposure using a xenon lamp, halogen lamp, tungsten lamp or fluorescent lamp as a light source, laser exposure using a semiconductor laser or a gas laser such as an argon laser or helium neon laser, or contact exposure through a transparent positive film, and then toner developing. Toner images can also be formed by charging and developing the photoconductive layer, after imagewise exposure, utilizing a memory effect.

The process of developing charged latent images using a toner falls into two types; namely, a dry process which uses a developer comprising a solid toner and a solid carrier, and a wet process which uses a liquid developer comprising a liquid carrier. In the invention, the wet process is needed for its capability of providing images of high resolution.

The toner developing conditions necessary for giving a toner layer transmission density of 0.6 or more depend upon a photosensitive printing plate or a liquid developer used. But, in the case of a liquid developer whose transmission density per unit toner layer thickness (weight/unit area) is 0.03 $dm^2/mg$ or more, it is possible to determine preferable developing conditions.

The preferred development conditions of the invention are a developing time of 6 to 20 seconds, a distance between electrodes of 1 to 3 mm, and a development bias voltage of 0 to ±50 V.

Preferably, the post exposure (overall exposure) in the photomechanical process of the invention is carried out using active rays having a wavelength region to which a photo-solubilizable photosensitive compound is sensitive and a toner layer has a screening property, while keeping the photosensitive layer side of a photosensitive printing plate being processed at a temperature of 50° C. or more. The temperature at the overall exposure is preferably 50° to 160° C., and more preferably 50° to 130° C. In this post exposure, the light used for irradiation must be active rays having a wavelength region to which the photo-solubilizable photosensitive compound is sensitive and the toner layer has a screening property, and as long as this requirement is satisfied, there can be used various light sources and irradiation methods.

Accordingly, suitable light sources can be properly selected from UV light sources such as high voltage mercury lamps, ultra-high voltage mercury lamps, metal halide lamps, carbon arc lamps, and lasers which generate ultraviolet light (excimer lasers, etc.).

The means to heat a photosensitive printing plate during the post exposure can be arbitrarily selected; preferred are infrared heaters, ultraviolet heaters, panel heaters, heat rollers and hot air heaters.

Such heating exposure is carried out in a mode where a photosensitive printing plate is kept travelling, or in a mode where a photosensitive printing plate is stopped while exposing; but, the former is preferred for continuous automatic processing. It is desirous that a contrivance be made to prevent local heating and give uniform overall heating. It is also preferred that the light source be reciprocated while a photosensitive printing plate is kept travelling. Further, arranging a plurality of heating means is preferred, too.

Heating of a photosensitive printing plate may be made by either heat emission or heat conduction. It may also be achieved by preheating immediately before overall exposure a photosensitive printing plate from the reverse side in a heat conduction mode and, irradiating heat with a lamp, etc.

The overall exposure according to the invention is carried out at an exposure intensity of 10 mW to 100 W, preferably 1 to 30 W at the surface of a photoconductive layer.

In a preferred embodiment of the invention, the overall exposure is conducted by use of the light having an exposure intensity of 1 W/cm$^2$ or more at the surface of the photoconductive layer, so that the exposing time is shortened and the heating of a printing plate is accelerated.

In the mechanical process of the invention, various methods can be employed to supply a photoconductive layer removing solution. Preferred examples include the method disclosed in Japanese Pat. O.P.I. Pub. No. 25477/1983, in which a photoconductive layer removing solution is kept circulating and sprayed onto a photosensitive printing plate conveyed horizontally; the method disclosed in Japanese Pat. O.P.I. Pub. No. 013149/1989, in which a photosensitive printing plate is conveyed in an incurvated form in a dipping tank filled and replenished with a large amount of photoconductive layer removing solution; and the methods disclosed in Japanese Pat. O.P.I. Pub. Nos. 243455/1986, 246750/1986 and 197950/1988, in which a fresh solution is applied to the plate surface by coating or the like.

After feeding a photoconductive layer removing solution, non-image portions of a photosensitive printing plate, where no toner image layer is formed, are removed by dissolving with the aid of mechanical means such as showering, rolling or brushing. The dissolving may be carried out, leaving the photoconductive layer removing solution unremoved. However, in view of preventing scratches, it is preferred that the dissolution be carried out by using a solution having solubility power to the photoconductive layer lower than that of the photoconductive layer removing solution, for example, water or a water containing a surfactant or alkali agent.

When the photoconductive layer contains a pigment such as a coloring pigment or photoconductive pigment, mechanical rubbing with a rubbing member to be pressed against the recording material, such as a sponge roller or brush, cannot be dispensed with.

In case a colorant absorbing visible light is used as a colorant for toner, it is preferable to add, during or after the dissolution, a process to remove a toner remaining on the image portions.

The hydrocarbon solvents described in Japanese Pat. O.P.I. Pub. Nos. 66863/1981, 130766/1981 or the sparingly water soluble organic solvents described in Japanese Pat. Appl. No. 245105/1991 are favorably used in the above removing process.

When the toner removal is necessary, it is performed, after completion of etching, either after or without rinsing. Rubberizing may be carried out after the toner removal, it can also be performed before the toner removal. Further, rinsing may be made after the toner removal.

The method for feeding a toner removing solution to the printing plate is not particularly limited; but, it is preferable to feed this removing solution concurrently with rubbing work using a brush or roll, in order to help the toner removal.

EXAMPLES

The invention is illustrated by the following examples in which parts are parts by weight unless otherwise stated.

Example 1

A dispersion of the following composition was prepared.

| | |
|---|---|
| Phenol resin of the following structure | 50 parts |

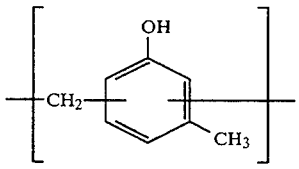

average molecular weight: 1500

| | |
|---|---|
| Liophoton EK (ε-type copper phthalocyanine made by Toyo Ink Mfg. Co.) | 20 parts |
| Propylene glycol monomethyl ether | 350 parts |

The above phenol resin was dissolved in propylene glycol monomethyl ether and, after filtering the solution, the above phthalocyanine was added. Then, the resulting mixture was dispersed for 3 hours with a Dainomill sand grinder disperser made by Shinmaru Enterprise Co. to obtain a dispersion.

The following quinonediazide compound solution was added to this dispersion.

| | |
|---|---|
| Ester compound of a phenol resin having the following structure with o-naphthoquinonediazide-5-sulfonic acid (esterification ratio: 25%) | 30 parts |

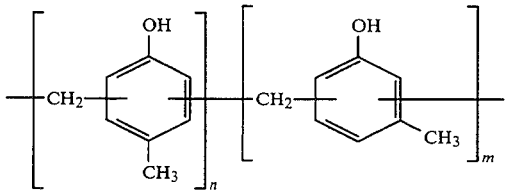

n:m = 1:2 average molecular weight: 2000

| | |
|---|---|
| Propylene glycol monomethyl ether | 150 parts |

The resulting dispersion prepared as above was filtered using a Filter HT-50 made by Nippon Roki Co. (filtering precision: 0.5 μm) to obtain dispersion-1.

A photosensitive planographic printing plate was prepared by coating the above dispersion-1 on a 0.3-mm thick grained and anodized aluminium plate so as to obtain a photoconductive layer having a dry coating thickness of 4 μm.

A liquid developer containing a negatively charged toner consisting of the following composition was prepared.

| | |
|---|---|
| 10% weight % ISOPAR G solution of octadecyl methacrylate/methacrylic acid copolymer | 10 parts |

-continued

| | |
|---|---|
| (90:5, molar ratio) | |
| MA-100 (carbon black made by Mitsubishi Kasei Corp.) | 1 part |

The above mixture was dispersed for 5 hours with glass beads. After adding 2 parts of Sanwax 171P (polyethylene made by Sanyo Chemical Ind. Co., average molecular weight: 1500), the mixture was heated to 80° C. and further dispersed for 3 hours. The dispersion was diluted to 1/80 with ISOPAR G to obtain a liquid developer.

The above photosensitive printing plate was positively charged with an applied voltage of 6 kV and, then, subjected to contact exposure through a positive film original to form a latent image. The electric potential at an unexposed portion was about ±250 V, and that at an exposed portion was about +30 V. The photosensitive printing plate having the latent image was subjected to development using the above liquid developer, under the following conditions. Developing time: 7 sec, the distance between electrodes: 2 mm, bias voltage: +40 V.

The transmission density per unit thickness $D_{unit}$ of the toner layer according to the invention is determined by the following:

The weight $W_1$ (in mg) of 100 $cm^2$ (1 $dm^2$) of a developed photosensitive planographic printing plate having a toner layer (solid portion) is measured. After the toner layer has been removed by a toner remover such as carrier liquid, the weight $W_2$ (in mg) of the resultant plate is measured. The toner amount same as that on the developed plate is provided on a transparent support to obtain a sample for measuring transmission density. The transmission density D of the sample is measured by means of a spectrophotometer using the same wavelength as that of actinic light for overall exposure. The transmission density per unit thickness $D_{unit}$ of the toner layer according to the invention is calculated from the following equation:

$$D_{unit}=D/(W_1-W_2)\ (dm^2/mg)$$

The toner layer thickness of the resultant toner image was 10 mg/$dm^2$, and the transmission density was 1.0 to light wavelength of 390 nm; namely, the transmission density per unit thickness was 0.1 $dm^2$/mg.

Subsequently, the developed photosensitive printing plate was placed on a hot plate heated to 80° C. and subjected to overall exposure using a metal halide light source to be a light intensity 2 minutes of 10 mW/$cm^2$ at the surface of the photoconductive layer.

Then, the photosensitive printing plate was immersed in a 1/7 diluted solution of Konica PS Plate Developer SDP-1 (made by Konica Corp.) at 25° C. After being taken out, it was rubbed with a sponge in water to remove a photoconductive layer at non image portions. A planographic printing plate was so prepared.

Example 2

A dispersion of the following composition was prepared.

| | |
|---|---|
| Ester compound (esterification ratio: 25%) of a phenol resin having the following structure with o-naphthoquinonediazide-4-sulfonic acid | 30 parts |

-continued

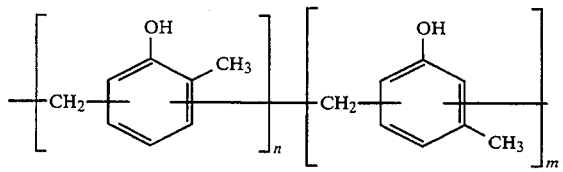

n:m = 1:3
average molecular weight: 1000

| | |
|---|---|
| A phenol resin of the following structure | 50 parts |

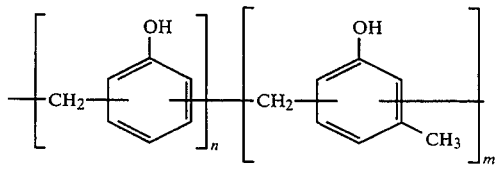

n:m = 1:3
average molecular weight: 2000

| | |
|---|---|
| Liophoton EK (ε-type phthalocyanine made by Toyo Ink Mfg. Co.) | 20 parts |
| Propylene glycol monomethyl ether | 500 parts |

Dispersion-2 was prepared by dissolving the above naphthoquinonediazide compound and resin in propylene glycol monomethyl ether to obtain a solution, filtrating the solution to obtain a filtrate, adding the above phthalocyanine to the filtrate, and dispersing the mixture for 1 hour with the aid of glass beads.

A photosensitive planographic printing plate was prepared in the same manner as in Example 1, except that dispersion-2 was used.

The thus obtained photosensitive plate was subjected to the process of the invention using an apparatus combining the unit of FIG. 1 and the unit of FIG. 2 illustrated in Japanese Pat. O.P.I. Pub. No. 27152/1983. In this apparatus, an overall exposure unit was equipped between the unit of FIG. 1 and the unit of FIG. 2.

The development conditions were the same as those in Example 1. The toner layer thickness of the resultant toner image was 10 mg/$dm^2$ the transmission density was 10 with a light wavelength of 390 nm; and the transmission density per unit thickness was 0.1 $dm^2$/mg.

The developed photosensitive plate was conveyed automatically at a conveying speed of 5 cm/sec, and overall exposure was carried out at an exposure intensity of 50 w/$cm^2$ at the surface of the photoconductive layer and at a temperature of 100° C. at the surface of the photoconductive layer. After overall exposure, the plate was processed with the same solution as that in Example 1 to obtain a planographic printing plate.

Comparative Example 1

A toner image was formed in the same manner as in Example 1, except that PPC-1000 (made by Ricoh Co., liquid developer for PPC) was used as toner. The toner layer thickness of the toner image was 5 mg/$dm^2$, and the transmission density was 0.5 at 390 nm; namely, the transmission density per unit thickness was 0.1 $dm^2$/mg.

Then, post exposure and removal of non-image portions were carried out in the same manner as in Example 1.

Comparative Example 2

A toner image was formed in the same manner as in Example 1, except that LOM-ED III (made by Mitsubishi Paper Mills, liquid developer for zinc oxide master) was used as toner, that a negative film was used as an original, and that reversal development was performed at a bias voltage of 250 V. The toner layer thickness of the toner image was 10 mg/dm$^2$, and the transmission density was 0.2 at 390 nm; namely, the transmission density per unit thickness was 0.02 dm$^2$/mg.

Then, post exposure and removal of non-image portions were carried out in the same manner as in Example 1.

Comparative Example 3

A toner image was formed in the same manner as in Example 1, except that LOM-ED III (made by Mitsubishi Paper Mills, liquid developer for zinc oxide master) was used as toner, that developing time was 20 seconds, that a negative film was used as an original, and that reversal development was performed at a bias voltage of 250 V. The toner layer thickness of the toner image was 30 mg/dm$^2$, and the transmission density was 0.6 at 390 nm; namely, the transmission density per unit thickness was 0.02 dm$^2$/mg. The toner image obtained as above had image defects such as poor dot reproduction in shadow portions and heavy fogging in non-image portions.

Then, post exposure and removal of non-image portions were carried in the same manner out as in Example 1.

The planographic printing plates prepared in Example 1 and Comparative Examples 1 to 3 were evaluated on the following items:

(Check Points)

Dot reproducibility reproduction range of 150 lines/inch dots after dissolution treatment of 30 seconds Fine line reproducibility: reproduction of FOGRA fine lines after dissolution treatment of 30 seconds Dissolution latitude (1) : thinning rate (μm/sec) of line widths in a prolonged dissolution treatment after 30 second dissolution Dissolution latitude (2): reproduction range of 150 lines/inch dots after dissolution treatment of 40 seconds Fog: fog density after dissolution treatment of 30 seconds (Macbeth densitometer, orange filter)

The results are shown in Table 1.

TABLE 1

| | Dot Reproducibility | Fine Line Reproducibility (μm) | Dissolution latitude (1) | Dissolution latitude (2) | Fog |
|---|---|---|---|---|---|
| Example 1 | 2–98% | 12 | 0.1 | 2–98% | 0.05 |
| Example 2 | 2–98% | 12 | 0.1 | 2–98% | 0.05 |
| Comp. Example 1 | 4–98% | 16 | 0.5 | 10–98% | 0.05 |
| Comp. Example 2 | 5–98% | 20 | 1.0 | 20–98% | 0.05 |
| Comp. Example 3 | 3–90% | 16 | 0.3 | 5–90% | 0.20 |

It can be understood, from the above results, that the photomechanical process of the invention is excellent in dot reproducibility and fine line reproducibility and has a considerably high dissolution latitude.

What is claimed is:

1. A process for manufacturing a planographic printing plate using a photosensitive planographic printing plate comprising an aluminum plate and, provided thereon, a photoconductive layer containing in admixture an alkali soluble resin, a photoconductor in an amount of 5 to 25% by weight and a photosolubilizable photosensitive compound in an amount of 20 to 50% by weight, said process comprising the steps of:

(A) charging the photoconductive layer;

(B) imagewise exposing the charged layer to form an electrophotographic latent image on the photoconductive layer;

(C) developing the latent image on the photoconductive layer with liquid developer to form a toner image layer having a transmission density of the toner image layer to the actinic light not less than 0.6, and a transmission density per unit thickness of the toner image layer to the actinic light not less than 0.03 dm2/g, whereby the toner image layer has a screening property to actinic light;

(D) heating the developed photoconductive layer at a temperature of 50° to 160° C.;

(E) uniformly exposing overall to the actinic light the entire photoconductive layer through the formed toner image layer, said actinic light having a wavelength to which the photosolubilizable photosensitive compound is sensitive; and (F) removing the photoconductive layer where no toner image layer has been formed.

2. The process of claim 1, wherein said photoconductor includes an organic photoconductive pigment.

3. The process of claim 2, wherein said organic photoconductive pigment includes a phthalocyanine pigment.

4. The process of claim 1, wherein said photosolubilizable photosensitive compound comprises an esterified compound of o-naphthoquinonediazide sulfonic acid with a phenol resin, said phenol resin being a polycondensation compound of a phenol with an aldehyde or a ketone, and the content of the o-naphthoquinonediazide sulfonic acid residue is $0.4\times10^{-3}$ to $3.0\times10^{-3}$ mole per gram of the photoconductive layer.

5. The process of claim 4, wherein the condensation ratio of said o-naphthoquinonediazide sulfonic acid to a hydroxyl group in the phenol resin in said esterified compound is 15 to 80 mole %.

6. The process of claim 4, wherein said o-naphthoquinonediazide sulfonic acid is o-naphthoquinonediazide-4-sulfonic acid.

7. The process of claim 4, wherein said phenol includes phenol, o-cresol, m-cresol or p-cresol and said aldehyde includes formaldehyde.

8. The process of claim 4, wherein said phenol resin includes a polycondensation product of p-cresol with formaldehyde.

9. The process of claim 1, wherein said alkali-soluble resin includes a novolak resin or an acrylic resin.

10. The process of claim 9, wherein said novolak resin is selected from the group consisting of phenol/m-cresol/formaldehyde resin, o-cresol/m-cresol/formaldehyde resin, m-cresol/p-cresol/formaldehyde resin, o-cresol/m-cresol/p-cresol/formaldehyde resin and phenol/m-cresol/p-cresol/formaldehyde resin.

11. The process of claim 9, wherein said novolak resin is phenol/m-cresol/p-cresol/formaldehyde resin.

12. The process of claim 1, wherein said aluminum plate is an anodized aluminium plate.

* * * * *